United States Patent [19]

Kiisler et al.

[11] Patent Number: 4,518,453

[45] Date of Patent: May 21, 1985

[54] METHOD OF PROCESSING THE OUTSIDE SURFACES OF A SKI

[76] Inventors: Karl R. Kiisler, Yakhimekhe tee, 26; Tiiya-Maya F. Sjuld, ulitsa Vyayana, 14, kv. 2; Peep G. Kristyanson, ulitsa Sjutiste tee, 34, kv. 38, all of Tallin; Gunnar B. Kholm, ulitsa Vyidu 18, kv. 10, Pyarnu; Juri K. Rokk, ulitsa Oya, 112 "b", kv. 41, Pyarnu; Kalju M. Post, ulitsa Lekhola, 69, Pyarnu, all of U.S.S.R.

[21] Appl. No.: 504,810

[22] Filed: Jun. 16, 1983

[30] Foreign Application Priority Data

Jun. 17, 1982 [SU] U.S.S.R. ..... 3457547

[51] Int. Cl.[3] ..... A63C 5/00; A63C 5/12; C09J 5/02; C09J 5/06

[52] U.S. Cl. ..... 156/307.5; 156/307.7; 156/322; 156/331.3; 156/335; 280/610

[58] Field of Search ..... 280/610; 156/307.7, 156/307.5, 322, 60, 331.3, 335

[56] References Cited

U.S. PATENT DOCUMENTS

| | | | |
|---|---|---|---|
| 2,184,791 | 12/1939 | Broome | 280/610 |
| 3,628,802 | 12/1971 | Hashimoto et al. . | |
| 3,707,296 | 12/1972 | Palazzolo et al. . | |
| 3,832,251 | 8/1974 | Aarna | 156/60 |
| 4,077,652 | 3/1978 | McCaskey, Jr. et al. . | |

FOREIGN PATENT DOCUMENTS

| | | | |
|---|---|---|---|
| 349366 | 4/1979 | Austria . | |
| 1939334 | 3/1973 | Fed. Rep. of Germany . | |
| 2407971 | 8/1975 | Fed. Rep. of Germany . | |
| 2647405 | 4/1977 | Fed. Rep. of Germany . | |
| 3003537 | 8/1980 | Fed. Rep. of Germany . | |
| 58438 | 10/1980 | Finland . | |
| 36326 | 4/1978 | Japan | 280/610 |

OTHER PUBLICATIONS

"Protection of Ski Top Surfaces", by Willi Kraus, Isovalta Co., Austria.

*Primary Examiner*—James C. Cannon

*Attorney, Agent, or Firm*—Fleit, Jacobson, Cohn & Price

[57] ABSTRACT

The outside surfaces of a ski are made by treating a fibrous material with a compound based on phenolic resin and containing 60 to 80 mass percent of dry matter, said phenolic resin being curable at 100° to 120° C., whereupon the thus-treated fibrous material is allowed to stand at 70° to 90° C. for a period of time long enough for said phenolic resin to partially polycondense, whereupon said material is applied to the ski blank and the resultant intermediate product is exposed to the effect of a temperature ranging within 100° and 120° C. and a pressure ranging within 0.5 and 2.0 MPa for complete polycondensation of said phenolic resin to occur and for said fibrous material to firmly adhere to the ski blank at the same time.

7 Claims, No Drawings

METHOD OF PROCESSING THE OUTSIDE SURFACES OF A SKI

FIELD OF THE INVENTION

The present invention relates generally to production of wooden and wooden-plastic skis and more specifically to a method of processing the outside surfaces of skis.

BACKGROUND OF THE INVENTION

The invention will find widespread application in making sports racing skis, as well as skis for adults, juveniles and children.

Diverse service and application conditions impose certain requirements upon the design of skis, largely the ability to retain strength and high elasticity at a minimized weight. Mechanical characteristics responsible for high performance quality of a ski dictate extremely complicated construction of up-to-date skis involving the use of various types of material (plastics, special coatings). Wood is used for the purpose as a filler only.

A modern ski blank may be regarded as a multi-ply material built up of the following layers: a top layer establishing the outside ski surface; a reinforcing layer; a wedge; another reinforcing layer; and a bottom layer (bed) serving as an external sliding face of the ski.

The outside (top) surface of a ski serves not only as the carrier of advertising slogans but also as a preventer of wear, detrimental effect of water or mechanical damage by the points of ski poles or stones. In addition, the outside surface of a ski imparts solidity thereto and serves as its construction element.

It is acryl-butadiene-styrene mixtures suggested by the firm Isovolta-Isosport (Austria) that are gaining most extensive application nowadays as the materials forming the outside surfaces of skis.

According to the method proposed by the afore-mentioned firm, the pellets of the acryl-butadiene-styrene mixture, after having been softened at an elevated temperature, are subjected to extrusion to produce a web whose width may be equal to that of either of the outside surfaces (top or bottom) of the ski being manufactured, for instance, 900 mm. The thus-obtained web is suitable for prolonged storage after having been reeled up into rolls on special devices. The final operation of the ski making process, i.e., producing the outside surfaces of a ski, is carried out by applying to the ski blank first a layer of epoxy adhesive, then a web built up of a mixture of acryl-butadiene-styrene; after exposing the ski blank to the effect of elevated temperature and pressure one can obtain an adequately strong joint of the aforementioned ski components. Some other adhesive compositions may be used for bonding together the ski blank and web forming the outside surfaces of the ski. However, it is expedient in such cases to pretreat one of the surfaces to be bonded either chemically or electronically so as to expedite chemical softening of the material and to increase the degree of roughness of the surface to be bonded (cf., e.g., U.S. Pat. No. 4,077,652).

However, the known method discussed above fails to provide higher structural characteristics of the ski as a whole, while the outside surfaces of the ski are highly liable to attrition wear and vulnerable to mechanical damage.

Another method of processing the outside surfaces of a ski is known, wherein used as a material forming the outside surfaces of the ski are laminated plastics obtained by impregnating some fibrous materials, such as paper, with thermosetting synthetic resins, followed by exposing them to high-pressure moulding. The various properties of the resultant laminated plastics depend upon the type of resin used as an impregnant. For instance, U.S. Pat. No. 3,707,296 describes melamine (a combination of formaldehyde and phenolformaldehyde resins) as an impregnant. The laminated plastics with such an impregnant is produced at 130° to 160° C. and a pressure of about 5 to 10 MPa in special presses.

Finnish Pat. No. 58,438 describes the use of fibrous matter in the form of loose mechanically non-adhered particles impregnated with epoxy resins curable at elevated tempertures, as the material to form the outside surfaces of a ski.

U.S. Pat. No. 3,628,802 discloses a possibility of using polyester, epoxy and polyurethane resins or mixtures thereof as an impregnant.

Austrian Pat. No. 349,336 describes a laminated material used to establish the outside surfaces of a ski, said material being composed of a fibreglass-reinforced layer of epoxy resin and a plastic film mechanically adhered thereto, said fibreglass-reinforced layer of epoxy resin being obtained by impregnating the fibreglass material with epoxy resin in combination with an appropriate amount of a curing agent.

According to FRG Pat. No. 1,939,334 the laminated material serving further as the outside surfaces of a ski, is made of plastic sheets by applying a thermosetting adhesive thereto, followed by curing said adhesive at a pressure and elevated temperature. Used as said adhesive is a mixture of 1,2-polybutadiene, a peroxide polymerization initiator and a chain extender.

All the laminated plastics mentioned hereinabove are bonded together with the ski blank by epoxy adhesive at elevated temperature and pressure. Alongside with epoxy adhesive used as a bonding matter may be a curable condensation product of formaldehyde, urea or melamine, phenol, resorcinol obtained after evaporation of the solvent.

As can be evident from the above-discussed, the process for production of laminated plastics is rather complicated, being as a matter of fact an individual technological process. In addition, the resultant laminated plastics are unfit for immediate use in making the outside surfaces of skis.

Thus, for example, the laminated plastic material needs pretreatment, before being applied to a ski blank, of its surface either chemically or electronically to improve adhesion on the surface to be bonded.

Moreover, the laminated plastics need be cut in pieces of a required size corresponding to the side surface, sliding face and top surface of a ski before being applied to the ski blank, which also sophisticates the method of making the outside surfaces of a ski.

FRG Pat. No. 2,407,971 describes a method of making the outside surfaces of a ski, according to which a layer of a fibrous material, such as cellulose is applied to the sliding surface of the ski blank, whereupon liquid epoxy resin is sprayed from a jet onto the fibrous material layer in an amount required for said material to impregnate. Epoxy resin thus applied to the ski surface is cured concurrently with the binding the ski components together at elevated temperature and pressure in a special press.

However, the fact that uncured epoxy resin is used in the process of forming the outside surfaces of a ski is a negative factor for the attending personnel from the sanitary-hygienic viewpoint since liquid epoxy resin causes skin irritation which might develop eczema.

At present the best characteristics are displayed when testing the top outside surfaces of a ski, by the materials made on the base of phenolic resins. Unfortunately substitution of phenolformaldehyde resin for epoxy resins finds but restricted application due to high curing temperature of the former resin, whereas a maximum temperature allowed in making plastic skis lies within 110° and 120° C. With due regard to all as that discussed above, the following process techniques are suggested by the firm "Isovolta-Isosport-80" (Austria):

1. Impregnation of paper with a compound featuring high phenolic resin content.
2. Drying the impregnated paper till an incomplete curing of phenolic resin.
3. Three or four plies of the impregnated paper are pressed together in the corresponding multiplaten presses to a definite pressing program, complete curing of phenolic resin occurring concurrently.
4. One-sided sanding of three- or four-ply sheet materials and their cutting into desired sizes.

Further on, the thus-obtained material is bonded to the ski blank with expoxy adhesive. The thus-produced ski features high mechanical characteristics. However, the process techniques applied for ski production are rather sophisticated and cumbersome and, moreover, involve much cost.

Known heretofore is also the production of the outside surfaces of a ski (particulaly its sliding face) using a material based on high molecular-weight polyethylene. Use is also made of diverse materials based on polyester, epoxy, polyurethane and phenolic resins containing some reinforcers (cf. Finnish Pat. No. 58438). Used as reinforcing layers are, as a rule, fibreglass plastics that impart excellent load-resisting properties to the ski.

However, when making skis from the aforementioned materials, specific properties of the bonding materials are of special importance, that is, special adhesives are required. Dense materials are bonded together as a rule with solvent-free epoxy adhesives. FRG Pat. No. 2,647,405 describes the use of the condensation product of formaldehyde, urea or melamine, phenol and resorcinol obtained after evaporation of the solvent, for bonding the outside surfaces of a ski. The bonding occurs at the second stage after the surfaces being bonded together have been forced against each other and cured at high temperatures.

FRG Pat. No. 3,003,537 describes the use of a polyamide layer instead of an adhesive for bonding the top outside surfaces of a ski, since polyamide is liable to melt down at elevated temperatures and to bond the surfaces together. However, the ski formation techniques applied by the various manufacturers differ but negligibly: when assembling a ski the reinforcer material is coated by a layer of adhesive on both sides to obtain a combination material composed of the top surface, fibre-glass plastic, ski blank, fiber-glass plastic and sliding face and subject to pressure-moulding in a ski-producing press.

As is obvious from the above discussion, the processes for production of materials made use of in making the outside surfaces of a ski are rather sophisticated independent techniques, and the materials thus produced are subject to chemical or electronic treatment before use in order to improve adhesion on the surface to be bonded. Besides, laminated plastics should be cut to pieces of a required size to suit the ski side surface before assembling the ski.

OBJECTS OF THE INVENTION

It is a primary and essential object of the present invention to provide such a method of processing the outside surfaces of a ski that would make its production process techniques simpler and cheaper.

It is another object of the present invention to provide such a method of processing the outside surfaces of a ski that would make it possible to attain higher physico-mechanical characteristics of both the ski outside surfaces and the ski as a whole.

SUMMARY OF THE INVENTION

The aforementioned objects are accomplished due to the fact that in a method of processing the outside surfaces of a ski by applying to the ski blank a fibrous material pretreated with a compound based on a thermosetting resin, followed by exposing the ski outside surface to the effect of elevated temperature and pressure, according to the invention, use is made of a fibrous material treated with a compound based on phenolic resin and containing 60 to 80 mass percent of dry matter, said phenolic resin being curable at 100° to 120° C., whereupon said fibrous material is allowed to stand at 70° to 90° C. for a period of time long enough for partial polycondensation to be carried out, then said fibrous material is directly applied to the ski blank and is exposed to the effect of a temperature ranging within 100° and 120° C. and a pressure ranging within 0.5 and 2.0 MPa, with the result that complete polycondensation of said phenolic resin and strong mechanical adhesion of the fibrous material to the ski blank occur.

The method proposed in this invention makes possible production of highly elastic skis. Thus, the amount of deflection of such a ski equals 80 mm at a load of 342N, the ultimate strength of a ski with the proposed outside surface equals 1100N when exposed to a breaking load, an ultimate shear strength at the wood-to-plastic joint on the ski outside surface equals 9.5 MPa, the wooden component being liable to destruct. Besides, the production process is much simpler compared to that disclosed in U.S. Pat. No. 2,407,971, a number of special devices such as liquid resin feed jets and special cuvettes, can be dispensed with, and sanitary-hygienic conditions for the attending personnel are improved.

According to the invention the following compound is expedient to be used for treating the aforementioned fibrous material (in parts by mass):

oil-shale alkyl-resorcinols containing the OH-groups in an amount of 12.0 to 13.3 meq/g—100,
urea—30 to 45,
hexamethylenetetramine—31 to 43,
ethyleneglycol—10 to 57,
water—31 to 63, whereby use may be made, as the sliding face of the ski being manufactured, of a polyethylene layer and the top sliding face and the side surfaces of the ski concurrently being all bonded with the ski component parts in a press at a maximum temperature of 120° C.

It is expedient, according to the invention, that used as a fibrous material is paper or a nonwoven fabric, whereby the outside ski surfaces can be strengthened most efficiently as against ski deflection under load, its bending strength, etc.

Other objects and advantageous features of the present invention will become evident from a detailed description of a method of processing the outside surfaces of a ski that follows.

DETAILED DESCRIPTION OF THE INVENTION

An initial stage of the method proposed in the present invention consists in treating a fibrous material, such as paper or nonwoven fabric made of synthetic or natural fibres, with a compound based on phenolic resin and holding said material at 70° to 90° C. within a period of time long enough for said resin to dry and partially polycondense. The stage is a preliminary one and may be performed some days or even months before use of the pretreated material rather than immediately before making the outside surfaces of a ski. Thus, the fibrous material may be pretreated in a centralized way to render it suitable for the aforementioned purpose, a feature that proves to be one of the advantages of the method being claimed and is accounted for by the phenolic resin based compound itself devised by the authors of the present invention.

It was found expedient to treat the fibrous material with a compound based on phenolic resin, which imparts good physico-mechanical characteristics to the fibrous material.

A characteristic feature of the compounds proposed in the present invention is its dry-matter content ranging within 60 and 80 mass percent. Numerous experiments have shown that with the dry matter content of said compound below 60 mass percent no strong adhesion of the fibrous material with the ski blank is assured, whereas the compound with the dry matter content above 80 mass percent fails to provide uniform impregnation of the fibrous material with said compound due to too high viscosity of the latter.

In addition, the herein-proposed treatment compounds based on phenolic resin have been selected by the ability of phenolic resin to cure at 100° to 120° C.

The authors of the present invention suggest that the compound of the following mass-percent composition be used:

oil-shale alkyl-resorcinols containing the OH-groups in an amount of 12.0 to 13.3 meq/g—100,
urea—30 to 45,
hexamethylenetetramine—31 to 43,
ethyleneglycol—10 to 57,
water—31 to 63, or else the compound may have the following mass-percent composition:

5-methyl-resorcinol—100,
urea—30 to 57,
hexamethylenetetramine—40 to 55,
ethyleneglycol—13 to 73,
water—40 to 87.

The aforementioned oil-shale alkyl-resorcinols are extraction-isolated from the products of thermal treatment of oil shales whose occurrence is located in the Estonian Republic.

The compound proposed for treatment of the fibrous material may be obtained by intermixing oil-shale resorcinols, urea and ethyleneglycol at a temperature ranging within 80° and 90° C., whereupon the resultant mixture is cooled down to 50° C. and an aqueous hexamethylenetetramine solution is added thereto. Then the temperature of the compound is brought to 30° C. by vigorously stirring the latter and, whereupon stirring is continued until homogenization of the compound is obtained.

It is expedient that paper or nonwoven fabrics be used as an original fibrous material, since it is the aforesaid materials that will provide an efficient strengthening of the outside surfaces of a ski against deflection under a load and with respect to the bending strength. On the other hand, the use of fabrics made of synthetic or natural fibres which are known to have different strength characteristics depending upon whether said characteristics are determined along the warp or the weft thread, provides a possibility of imparting different mechanical properties to the ski when using the same material for its outside surfaces. Besides, nonwoven fabrics and paper feature equal strength in any direction of fibres, whereby such materials provide for uniform load distribution.

The present invention offers possibilities for treatment of adequately thick materials (up to 3 mm thick).

It is also expedient to use a fibrous material having the size of the outside ski surface that is to be formed, that is, it is expedient to cut the fibrous material into strips before treating with the phenolic-resin based compound, said strips being equal in width to, e.g., the top outside surface of the ski blank.

The fibrous material is treated with the aforedescribed compound based on phenolic resin and is then allowed to stand at 70° to 90° C. for a lapse of time long enough for the phenolic resin to undergo partial polycondensation. In other words, the thus-pretreated material is storable for an adequately prolonged period and can be reeled up into rolls without any detrimental effect to its surface. As has been stated hereinbefore the material held under the aforesaid conditions lends itself to centralized manufacture, whch is by far an advantageous feature of the present invention.

The fibrous material pretreated, according to the present invention, with a compound based on phenolic resin and held at 70° to 90° C. for a lapse of time long enough for said resin to experience partial polycondensation, may be applied for formation of the top, side and in some cases the sliding outside surfaces of a ski without preliminary sanding in, e.g., a belt sander or treating chemically or electronically which is the case in the heretofore known methods.

According to the present invention, the-thus preconditioned material is applied, without any adhesive layer, directly to the ski blank and is exposed to the effect of a temperature ranging within 100° and 120° C. and a pressure equal to 0.5 or 2.0 MPa. As a result, complete polycondensation of phenolic resin occurs and, by virtue of this, strong adhesion of the fibrous material with the ski blank is attained.

As a rule the ski blank is in fact composed of a layer of birch wood, a layer of epoxy adhesive, another layer of birch or white-spruce wood, another layer of epoxy adhesive, and one more birch-wood layer.

Thus, when exposed to the effect of the aforementioned temperature and pressure all the layers of the ski blank are bonded together with epoxy adhesive.

It is worth noting that the sliding face (i.e., the bottom outside ski surface) of sports racing skis for adults is expedient to be made of a layer of high-molecular polyethylene, which is known to soften or destruct at temperatures above 120° C. The herein-proposed production techniques make it possible to shape a ski substantially at a single stage without applying epoxy adhesive between the ski blank and the top and side outer surfaces of the ski, which has previously been unattainable by any means. Furthermore, it is due to simplified production techniques that the method proposed herein is instrumental in producing cheaper and more elastic skis as compared to skis whose outside surfaces are made of materials based on phenolic resins.

The outside surfaces of a ski processed according to the present invention feature, as has been stated hereinbefore, good strength characteristics and serve not only as protective superficial layer but as an additional structural element. Besides, an apparent advantage of the proposed method resides in the fact that the weight of a ski as a whole is reduced by 20 to 30 g due to dispensing with the layer of an adhesive, which has formerly been indispensable for bonding the ski blank together with the ski top outside surface.

EXAMPLE 1

Paper strips 60 mm wide (corresponding to the width of the ski being produced) and 1.4 mm thick are treated with a compound containing 100 parts by means of oil-shale alkyl-resorcinols with the content of the OH-groups ranging within 12.0 and 13.3 meq/g, 30 parts by mass of urea, 31 parts by mass of hexamethylenetetramine, 10 parts by mass of ethyleneglycol and 31 parts by mass of water, said compound containing 80 mass percent of dry matter. Then the paper strips impregnated with the aforesaid compound are held at 70° to 90° C. in a cabinet drier for 40 to 55 minutes for partial polycondensation of the compound to occur.

Next the material obtained in the aforesaid way is placed in a special press for making children's skis: first the ski blank (a layer of birch wood), a layer of an urea-based adhesive, another layer of birch or white-spruce wood, and the material prepared by the aforesaid way. Thereupon a temperature of from 100° to 120° C. and a pressure of from 0.5 to 2.0 MPa are built up in the ski-making press, whereby complete polycondensation of phenolic resin occurs and all the ski components are firmly bonded together. The thus-formed ski is subjected to testing according to commonly known procedures to obtain the following characteristics: an ultimate shear strength at the wood-to-plastic joint on the ski outside surface ranges within 8.5 and 9.5 MPa, the wooden ski component being liable to destruct.

EXAMPLE 2

Paper strips 55 mm wide (corresponding to the width of the ski being produced) and 2.0 mm thick are treated with a compound containing (in parts by mass): oil-shale alkyl-resorcinols having the content of the OH-groups ranging within 12.0 to 13.3 meq/g—100, urea—38, hexamethylenetetramine—37, ethyleneglycol—25, water 50, the dry-matter content of said composition being 70 mass percent. The paper strips impregnated with said compound are held at 70° to 90° C. in a cabinet drier for 45 to 60 minutes for partial polycondensation of the compound to occur.

The material obtained as described hereinbefore is then placed in a special ski-making press along with the ski blank, consisting of a layer of birch wood or fibre-glass plastic, a layer of epoxy adhesive, a layer of birch or white-spruce wood, a layer of epoxy adhesive, a layer of birch wood or fibre-glass plastic, a layer of epoxy adhesive, and a layer of polyethylene. Then a temperature of from 100° to 120° C. and a pressure of from 0.5 to 2.0 MPa are developed in the ski-making press, whereby complete polycondensation of phenolic resin occurs and all the ski components are firmly bonded together.

The thus-produced ski is exposed to testing according to commonly known procedures to obtain the following characteristics:

amount of the ski deflection under a load of 342N—80 mm;

ultimate strength of the ski under a breaking load—1100N;

ultimate shear strength at the joint of the top outside ski surface with the ski blank—8.5 to 9.5 MPa (the wooden blank component being liable to break).

EXAMPLE 3

A strip of a nonwoven fabric of the gasketing type having a thickness of 0.8 mm and a width of 65 mm coresponding to the width of the ski being produced, is treated with a compound containing (in parts by mass): 5-methyl-resorcinol—100, urea—38, hexamethylenetetramine—40, ethyleneglycol—13, water—40, the dry-matter content of said composition being 80 mass percent. The strips of said nonwoven fabric are impregnated with said compound and are then held in a cabinet drier for 30 to 40 minutes at 70° to 90° C. for the compound to undergo partial polycondensation.

Placed in a special ski-making press are the material obtained as described hereinbefore, the ski blank similar to that described in Example 2, and the material produced by the aforementioned procedure. Then a temperature of 100° to 120° C. and a pressure of 0.5 to 2.0 MPa are established in the ski-making press, whereby complete polycondensation of phenolic resin occurs and all the ski components are firmly bonded together.

The thus-produced ski is subjected to testing according to commonly known procedures to obtain the following characteristics:

amount of the ski deflection under a load of 342N—70 mm;

ultimate strength of the ski under a breaking load—1050N;

ultimate shear strength at the joint of the top outside ski surface with the ski blank—9 to 9.5 MPa (the wooden blank component being liable to break).

EXAMPLE 4

A cotton-fabric strip having a width of 55 mm corresponding to the width of the ski being produced, is treated with a compound having the following composition (in parts by mass):

5-methyl-resorcinol—100;
urea—47;
hexamethylenetetramine—48;
ethyleneglycol—28;
water—55;

and containing 70 mass percent of dry matter. The cotton-fabric strip impregnated with said compound is held in a cabinet drier for 40 to 45 minutes at 70° to 90° C. for the compound to undergo partial polycondensation.

Placed in a special ski-making press are the cotton-fabric strip treated in a way described above, the ski blank similar to that described in Example 2, and a polyethylene layer, whereupon a temperature of 100° to 120° C. and a pressure of 0.5 to 2.0 MPa are developed in the ski-making press, with the result that complete polycondensation of phenolic resin occurs and all the ski components are firmly bonded together.

The thus-produced ski is tested according to commonly known procedures to obtain the following characteristics:

amount of the ski deflection under a load of 342N—80 mm;

ultimate strength of the ski under a breaking load—1100N;

ultimate shear strength at the joint of the top outside ski surface with the ski blank—9 to 9.5 MPa (the wooden blank component being liable to destruct).

EXAMPLE 5

A paper strip 80 mm wide (corresponding to the width of the ski being produced) and 2.5 mm thick is treated with a compound having the following composition (in parts by mass):

oil-shale alkyl-resorcinols containing the OH-groups in an amount of 12.0 to 13.3 meq/g—100;

urea—45;

hexamethylenetetramine—43;

ethyleneglycol—57;

water—68, and containing 60 mass percent of dry matter. The paper strip impregnated with said compound is held in a cabinet drier for 55 to 65 minutes at 70° to 90° C. for the compound to undergo partial polycondensation.

Then placed in a special ski-making press are said paper strip, the ski blank similar to that described in Example 2, a polyethylene layer, whereupon a temperature of 100° to 120° C. and a pressure of 0.5 to 2.0 MPa are established in the ski-making press, with the result that complete polycondensation of phenolic resin occurs and all the ski components are firmly bonded together.

The thus-produced ski is exposed to testing according to commonly known procedures to obtain the following characteristics:

amount of the ski deflection under a load of 342N—40 mm;

ultimate strength of the ski under a breaking load—1000N;

ultimate shear strength at the joint of the top outside ski surface with the ski blank—8.5 to 9.0 MPa (the wooden blank component being liable to destruct).

EXAMPLE 6

A paper strip 65 mm wide (to suit the width of the ski being produced) and 1.2 mm thick is treated with a compound having the following composition (in parts by mass):

5-methyl-resorcinol—100;

urea—57;

hexamethylenetetramine—55;

ethyleneglycol—73;

water—87, and containing 60 mass percent of dry matter. The paper strip impregnated with said compound is held in a cabinet drier 55 to 65 minutes at 70° to 90° C. for the compound to undergo partial polycondensation.

Then said paper strip, the ski blank similar to that described in Example 2 and a polyethylene layer are placed in a special ski-making press, wherein a temperature of from 100° to 120° C. and a pressure of from 0.5 to 2.0 MPa are built up, with the result that phenolic resin experiences complete polycondensation and all the ski components are firmly bonded together.

The thus-produced ski is tested according to commonly known procedures to obtain the following characteristics:

amount of the ski deflection under a load of 342N—40 mm;

ultimate strength of the ski under a breaking load—1000N;

ultimate shear strength at the joint of the top outside ski surface with the ski blank—8.5 to 9.5 MPa (the wooden blank component being liable to destruct).

What we claim is:

1. A process for manufacturing at least one outside surface of a ski, comprising the steps of:

a. treating a fibrous material selected from the group consisting of paper, a non-woven fabric made of synthetic fiber, and a non-woven fabric made of natural fiber, with a compound comprising a phenolic resin, having a dry matter content of from about 60 to about 80 mass percent, and being curable at from about 100° C. to about 120° C.;

b. heating the treated fibrous material at from about 70° C. to about 90° C. for a period of time which is long enough for the phenolic resin to undergo partial polycondensation;

c. applying the partially polycondensed phenolic resin treated fibrous material directly to at least one outside surface of a ski blank; and d. exposing the ski blank with fibrous material applied thereto to a temperature of from about 100° C. to about 120° C. and a pressure of from about 0.5 MPa to about 2.0 MPa thereby causing complete polycondensation of said phenolic resin to occur and strong adhesion of said fibrous material to said ski blank.

2. A process according to claim 1, wherein said phenolic resin compound consists essentially of from about 100 pbm oil-shale alkyl-resorcinols having from about 12.0 meq/g to about 13.3 meq/g of OH-groups, from about 30 pbm to about 45 pbm urea, from about 31 pbm to about 43 pbm hexamethylenetetramine, from about 10 pbm to about 57 pbm ethyleneglycol, and from about 31 pbm to about 63 pbm water.

3. A process according to claim 1 or 2, which further comprises the step of cutting the fibrous material to the size of the outside surface of the ski blank to which it will be applied.

4. A process for manufacturing a strong and highly elastic ski, the ski including a top outside surface and edges which are comprised of a phenolic resin compound treated fibrous material applied directly to a ski blank, said ski blank being comprised of a plurality of plies at least one which is wood and having adhesive means therebetween, said strong and highly elastic ski being characterized by a deflection under a load of 342N of from at least about 40 mm to about 80 mm, an ultimate strength under a breaking load of from at least about 1,000N to about 1,100N, and an ultimate shear strength of the wood-to-plastic joint on the ski outside surface of from at least about 8.5 MPa to about 9.5 MPa, said process comprising the steps of:

a. treating said fibrous material selected from the group consisting of paper, a non-woven fabric made of synthetic fiber, and a non-woven fabric made of natural fiber, with said compound comprising a phenolic resin and having a dry matter content of from about 60 to about 80 mass percent and being curable at from about 100° C. to about 120° C.;

b. heating the treated fibrous material at from about 70° C. to about 90° C. for a period of time which is long enough for the phenolic resin to undergo partial polycondensation;

c. applying the partial polycondensed phenolic resin treated fibrous material directly to the top outside surface and edges of said ski blank; and d. exposing the ski blank with fibrous material applied thereto to a temperature of from about 100° C. to about 120° C. and a pressure of from about 0.5 MPa to about 2.0 MPa thereby causing complete polycondensation of said phenolic resin to occur and strong adhesion of said fibrous material to said ski blank.

5. A process according to claim 4, wherein said phenolic resin compound consists essentially of from about 100 pbm oil-shale alkyl-resorcinols having from about 12.0 meq/g to about 13.3 meq/g of OH-groups, from about 30 pbm to about 45 pbm urea, from about 31 pbm to about 43 pbm hexamethylenetetramine, from about 10 pbm to about 57 pbm ethyleneglycol, and from about 31 pbm to about 63 pbm water.

6. A process according to claim 4, which further comprises the step of cutting the fibrous material to the size of the outside surface of the ski blank to which it will be applied.

7. A process according to claim 4, 5, or 6, wherein the ski further includes a sliding outside surface and wherein the step of applying the partially polycondensed phenolic resin treated fibrous material further includes applying said material to the bottom outside surface of said ski blank.

* * * * *